US006188836B1

(12) United States Patent
Glucksman et al.

(10) Patent No.: US 6,188,836 B1
(45) Date of Patent: Feb. 13, 2001

(54) PORTABLE RADIANT HEATER WITH TWO REFLECTORS

(75) Inventors: Dov Z. Glucksman, Wenham; Karl H. Weidemann, Hull; Robert E. Wolfe, Holliston, all of MA (US)

(73) Assignee: Appliance Development Corporation, Danvers, MA (US)

( * ) Notice: Under 35 U.S.C. 154(b), the term of this patent shall be extended for 0 days.

(21) Appl. No.: 09/273,621

(22) Filed: Mar. 22, 1999

(51) Int. Cl.[7] ..... F24H 3/00
(52) U.S. Cl. ..... 392/376; 392/423; 392/373
(58) Field of Search ..... 392/376, 423, 392/425, 422, 374, 373, 375, 383; D23/335, 340

(56) References Cited

U.S. PATENT DOCUMENTS

| | | | | |
|---|---|---|---|---|
| 670,905 | | 3/1901 | Pittman . | |
| 2,754,400 | * | 7/1956 | Jacobson | 392/376 |
| 2,851,627 | | 9/1958 | Ferguson | 313/114 |
| 3,048,734 | | 8/1962 | Linnes | 313/116 |
| 3,051,820 | * | 8/1962 | Krichton | 392/376 |
| 3,115,302 | | 12/1963 | Corey . | |
| 3,246,121 | | 4/1966 | Fannon, Jr. et al. . | |
| 3,377,482 | | 4/1968 | Podany . | |
| 3,394,886 | | 7/1968 | Budden . | |
| 3,399,833 | | 9/1968 | Johnson | 237/53 |
| 3,431,449 | | 3/1969 | Hundley | 313/111 |
| 3,733,461 | * | 5/1973 | Rohats | 392/423 |
| 4,159,411 | | 6/1979 | Ellersick . | |
| 4,319,125 | | 3/1982 | Prince . | |
| 4,349,724 | | 9/1982 | Ellersick . | |
| 4,753,219 | | 6/1988 | Caferro | 126/307 |
| 4,835,367 | | 5/1989 | Hoffman . | |
| 4,929,866 | | 5/1990 | Murata et al. | 313/500 |
| 5,437,001 | | 7/1995 | Chaney et al. | 392/376 |
| 5,511,145 | | 4/1996 | Bailey et al. | 392/355 |
| 5,561,735 | | 10/1996 | Camm | 392/416 |
| 5,594,831 | | 1/1997 | Oparin et al. | 392/421 |
| 5,677,983 | | 10/1997 | Oparin et al. | 392/421 |
| 5,761,377 | | 6/1998 | Wolfe et al. . | |

FOREIGN PATENT DOCUMENTS

| | | | |
|---|---|---|---|
| 382099 | * | 9/1923 | (DE) . |
| 820732 | * | 11/1951 | (DE) . |
| 577196 | * | 1/1994 | (EP) . |
| 895032 | * | 2/1999 | (EP) . |
| 761383 | * | 3/1934 | (FR) . |
| 885105 | * | 9/1943 | (FR) . |
| 968495 | * | 11/1950 | (FR) . |
| 581791 | * | 10/1946 | (GB) . |
| 603926 | * | 6/1948 | (GB) . |
| 9103915 | * | 3/1991 | (WO) . |

* cited by examiner

*Primary Examiner*—John A. Jeffery
(74) *Attorney, Agent, or Firm*—George A. Herbster; Pearson & Pearson

(57) ABSTRACT

A portable radiant heater comprises an electrically energized heating element extending along a vertical axis. A first, multi-faceted, concave reflective surface is positioned to the rear of the heating element. A second reflector is positioned forward of and in close proximity to the heating element. The first reflector directs radiant energy received directly from the heating element and indirectly from the second reflector forward with minimal radial dispersion.

7 Claims, 4 Drawing Sheets

PORTABLE RADIANT HEATER WITH TWO REFLECTORS

BACKGROUND OF THE INVENTION

1. Field of the Invention

This invention generally relates to portable heating systems and more specifically to portable radiant heaters.

2. Description of Related Art

Portable heaters are used in a number of applications to provide localized heating. For example, U.S. Pat. No. 5,437,001 (1995) to Cheney et al. discloses an upright radiant electrical heater with a reflector assembly supporting a vertically extending heating element assembly. Energy radiates in all directions in a horizontal plane so the inherent radiation pattern is onmidirectional. The reflector assembly includes heat reflective panels that redirect energy directed to the rear through an open grill at the front of the heater. A fan forces room air into the heater from below the reflector assembly upwardly through an air passage behind the assembly into an open control chamber at the top of the heater and outwardly into the room through ducts along the top front edge of the assembly. The resulting air flow assures that accessible components remain cool to the touch.

U.S. Pat. No. 5,761,377 (1998) to Wolfe et al. depicts another portable radiant heater that includes a plurality of vertically oriented, horizontally spaced quartz heating tubes. A common reflector partially surrounds the heating tubes and is configured to open at an obtuse angle at each quartz tube. The reflector is perforated to allow air to pass out from the interior of the heater. A fan moves the air for cooling purposes.

As shown in both these patents and is generally found in commercially available portable radiant heaters, the heating elements themselves are directly visible from the front exterior of the heater. Consequently various standards require an increased spacing between such heating elements and any surface which an individual can contact. In the above identified Cheney et al. patent a cylindrical grill extends partially around the heating elements. In the Wolfe et al. patent the corresponding protection is provided by a flat grill piece. This requirement for extra spacing increases the bulkiness of such space heaters by increasing the front-to-back dimension, or depth, of the portable radiant heater. That is a disadvantage in many applications.

Typically in these heating systems an individual sees only one image of each heating element which is the view of the actual heating element itself. For many individuals the result is not pleasing aesthetically.

Further in these systems heating elements radiate heat omnidirectionally so forward directed radiant energy from the heating element disperses radially. The radial dispersal dissipates energy more rapidly than a directed beam as a function of distance from the source. Energy emanating from the rear of the heating elements is reflected by the rear reflector to direct that energy into a better defined beam. Nevertheless, the forward energy continues to disperse so portable radiant heaters tend to be inefficient.

SUMMARY

Therefore, it is an object of this invention to provide an improved portable radiant heater.

Another object of this invention is to provide an improved portable radiant heater that operates with maximum efficiency.

Still another object of this invention is to provide an improved portable radiant heater that has a minimum depth.

Yet another object of this invention is to provide an improved portable radiant heater that is aesthetically pleasing in appearance especially during operation.

In accordance with one aspect of this invention, a portable heater comprises a housing, a first reflector in the housing for directing energy in a first direction and a second reflector in the housing displaced from the first housing in the first direction for directing energy toward the first reflector. A radiant heater is located in the housing intermediate the first and second reflectors. The first reflector directs energy in the first direction that is received from the second reflector and the radiant heater.

In accordance with another object of this invention, a portable radiant heater comprises an upstanding housing comprising an open housing frame with front and rear frame surfaces and a curved back portion for spanning the rear frame surface. A first reflector has a concave, multifaceted reflective surface extending along a vertical axis through the upstanding housing and is positioned proximate the housing back portion. An elongated radiant heating element extends along an axis parallel to the vertical axis. A second reflector with at least one reflective surface faces the first reflector means and the radiant heater. A support carries the first and second reflectors and the radiant heating element on the housing frame with the first reflector being proximate the housing back portion.

In accordance with yet another aspect of this invention, a portable radiant heater comprises a frame for being supported in a vertical orientation including a back portion having a concave cylindrical surface formed about a vertical axis and an open frame for supporting the back portion. An electric radiant heater means includes a quartz radiant heating element that connects to a power source for energizing the heating element and a thermostat for controlling the energization of the heating element. A support carries the heating element and includes a bracket having a horizontal portion for connection to the housing means and a vertical portion and first and second vertically spaced end supports attached to the horizontal and vertical portions of the bracket respectively. The support means carries a first reflector including a plurality of planar members arranged along an arc with each planar member being tangent to the arc and having a reflective surface generally directed toward the radiant heater element. The support means also carries a second reflector on the opposite side of the heating element. The second reflector includes a reflector member having first and second parallel semi-hexagonal channels extending along channel axes parallel to the vertical axis and a support member for carrying the reflector member. Each of the channels has a reflective surface facing the heating element. First and second barriers adjacent opposite sides of the second reflector means that has a width that is less than the width of the first reflector.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
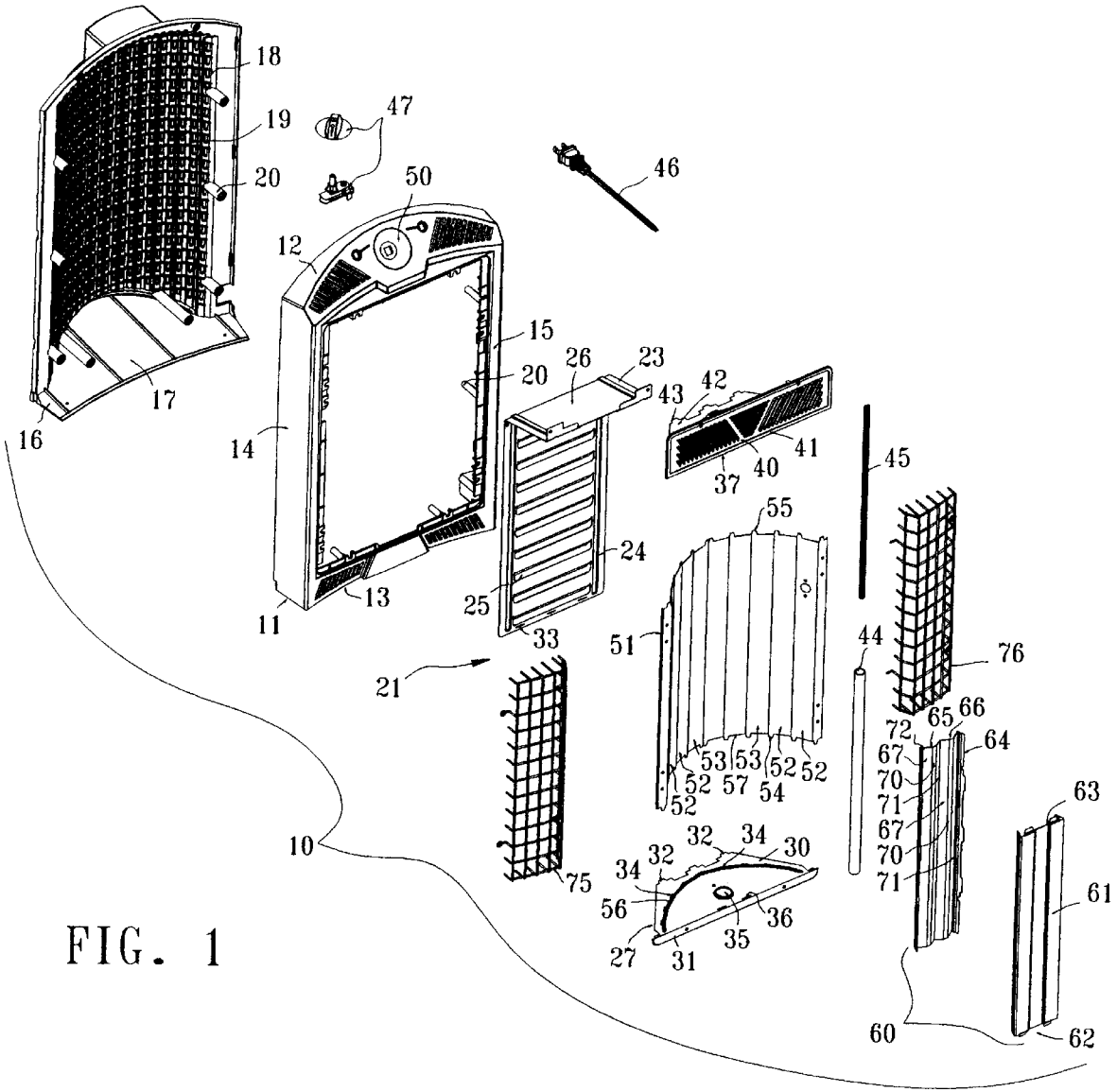
FIG. 1 is an exploded view of a portable radiant heater constructed in accordance with this invention.
Figure 2:
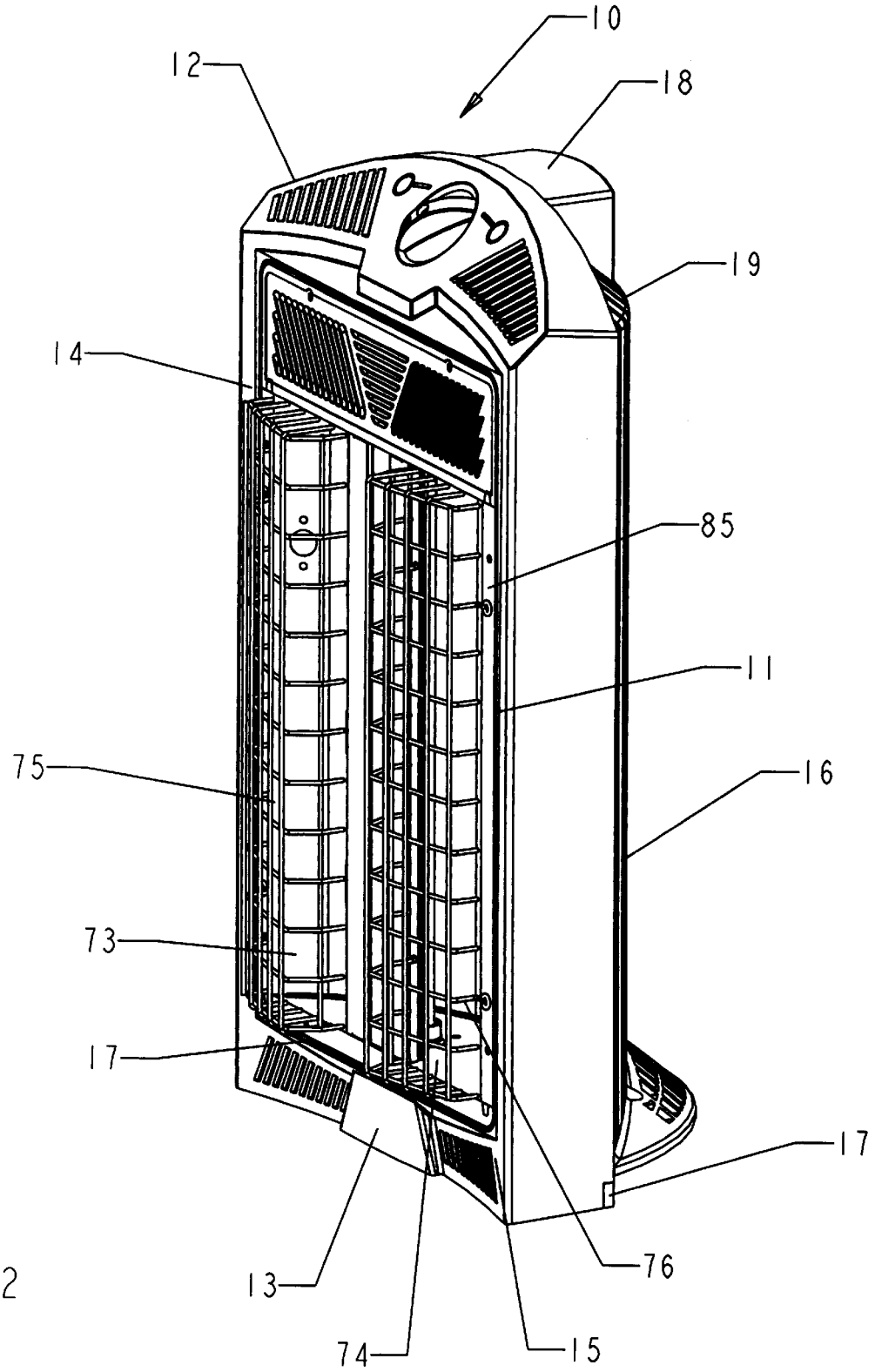
FIG. 2 is a perspective view of a portable radiant heater constructed in accordance with this invention.

Now referring to FIGS. 1 and 2, a portable radiant heater 10 constructed in accordance with this invention includes an open housing frame 11 designed to be in a vertical orientation having a top cross member 12, a bottom cross member 13 and left and right side walls 14 and 15 respectively in the orientation of FIG. 1. A rear housing 16 includes a base 17 and a vertical back wall 18 that curves about a vertical axis. The curved vertical back wall 18 may include an array 19 of air passages. Any number of specific arrays could be substituted for the specifically disclosed array provided that the sizes of individual air passages met various standards required for such devices. The housing frame 11 and rear housing portion 16 are formed into an integral structure through by plastic connectors 20 or other fasteners.

The housing frame 11 carries a subassembly 21 that includes a bracket 23 that has a back portion 24 with an optional array 25 of air passages and a top plate 26 at right angles to the back portion 24. The back portion 24 carries a lower end support 27 that has a plate portion 30 and a depending lip portion 31 that attaches to the bottom cross member 13. A plurality of tabs 32 in the plate portion 30 engage corresponding slots 33 at the bottom of the back portion 24.

The plate portion 30 additionally includes a plurality of linear slots 34 arranged along a arcuate path preferably a path defined by a constant radius arc. These slots 34 carry a first reflector as described later. The plate portion 30 additionally includes a mounting 35 for a radiant heater and another mounting 36 for a second reflector.

An upper end support 37 includes a face plate 40 with an optional array 41 of air passages. The face plate 40 also carries a plate portion 42 that extends at right angles to the plane of the face plate 40. Like the plate portion 30, the portion plate 40 includes tabs 43 for engaging slots (not shown) corresponding to slots 33 in the back portion 24 of the isolation bracket 23 and a plurality of slots, a mounting hole and another sets of slots that mirror slots 34, mount 35 and mount 36 of the plate portion 30.

The mount 35 carries a radiant heating element that, for purposes of this invention, is depicted as comprising a ceramic tube 44 and an electrical heater element 45 disposed within the tube 44. Various end terminations provide a mechanical connection to the plate portions 30 and 42 and electrical connections to a power cord 46 and thermostat 47. The thermostat 47 can conveniently be located at a mounting area 50 that may also include a separate on/off switch and a power on pilot light or other indicator.

When the heating element 45 is energized, radiant heat energy radiates from the ceramic tube 44 radially in all directions. Heat energy that radiates toward the back housing portion 16 is intercepted by a first reflector 51 that comprises a plurality of vertically oriented, thin, slat-like members 52, each with a planar reflective surface 53. Each member 52 includes a bottom mounting tab 54 and a top mounting tab 55. Each of the mounting tabs 54 engages one of the slots 34 in the plate portion 30; each of the upper tabs 55 corresponding slots in the plate portion 42.

In addition each planar member 52 is oriented in a plane that is tangent to the arc. In one embodiment individual planar members are angularly displaced by 75°from each other. Consequently, the assembly of members 52 defines a multi-faceted concave reflective cylinder along a vertical axis parallel to a corresponding axis through the ceramic tube 44. Each of the end supports may contain a series of segmented linear slots or indentations such as indentations 56 shown on the bottom end support 30 for engaging the remaining edges 57 of each member 52. This structure further stabilizes the subassembly 21.

Still in accordance with this invention, the mount 36 in the end support 30 and corresponding mount in the top end support 42 carry a second reflector 60 that reflects toward radiating energy from the ceramic tube 44. A front plate 61 constitutes a support with tabs 62 and 63 for engaging the mount 36 in the bottom end support 30 and corresponding mount in the top end support 42. In addition the front plate 61 carries a reflector element 64 formed by stamping, folding or otherwise a metal sheet into two parallel channels 65 and 66. These channels lie along axes that are parallel to the axis through the ceramic tube 44. In this particular embodiment each channel has three planar sides 67, 70 and 71 thereby to define, in cross-section, an irregular, semi-hexagonal reflective surface 72 that faces the ceramic tube 44.

Figure 4:
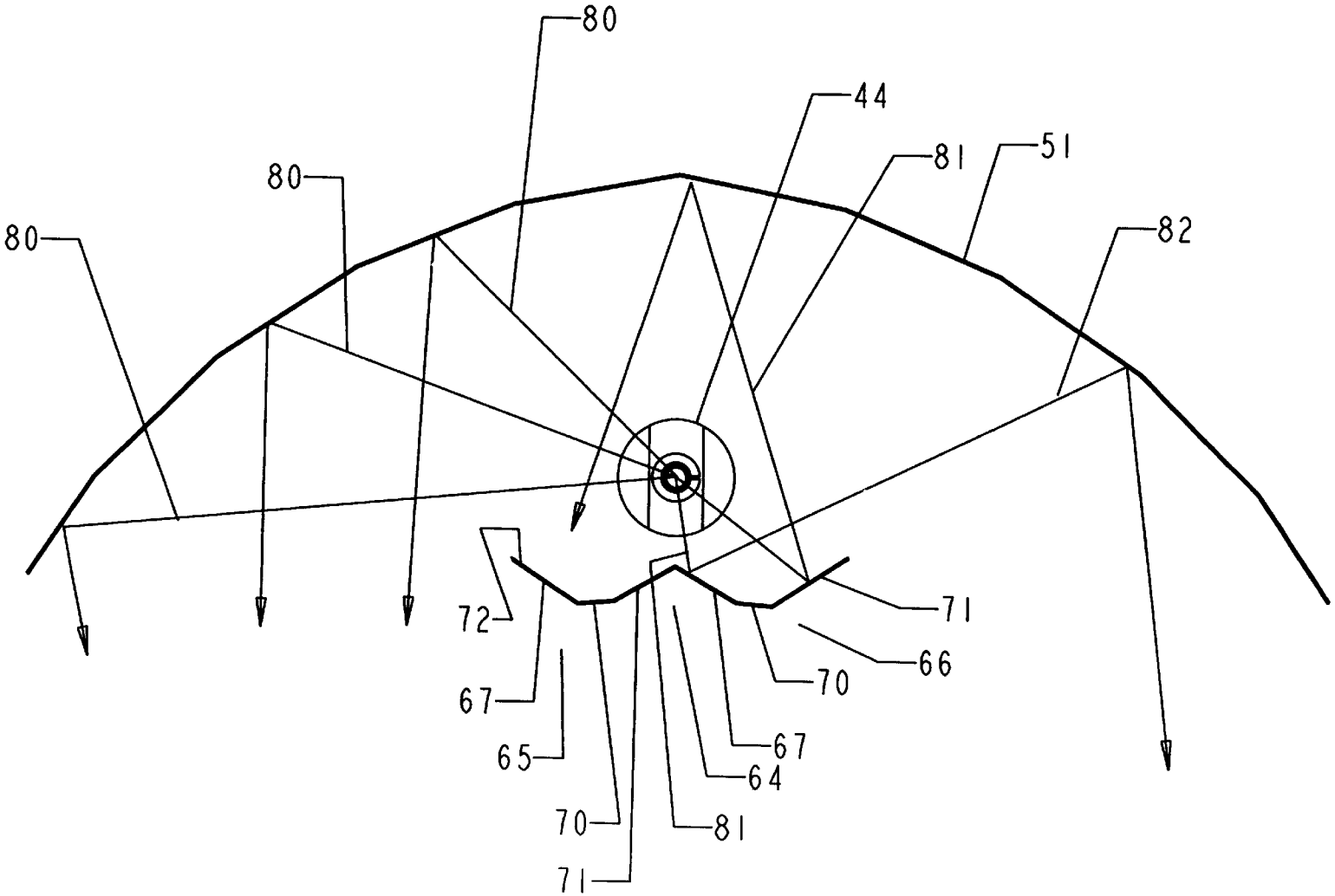
FIG. 4 is a diagram depicting certain reflections that occur in the portable radiant heater of FIG. 1.

FIG. 4 depicts a top plan view of the reflectors 51 and 64 with the second reflector 64 being positioned closely adjacent the ceramic tube 44. Consequently the reflective surfaces 72 in each of the channels 65 and 66 will intercept radiant energy dispersing forward and radially from the ceramic tube 44, i.e, from a forward portion of the ceramic tube 44. The surfaces 72 defined by the channels 65 and 66 reflect all this energy back toward the first reflector 51 that, in turn, redirects this reflected radiant energy forward in a more coherent manner. Commercially available reflective surfaces do not reflect the radiant energy with 100% efficiency. Nevertheless the redirection of essentially all the radially dispersing radiant energy from the ceramic tube 44 into a more collimated directed beam of radiant energy produced by the reflectors 51 and 64 provides more efficient radiant heating than otherwise possible without the two reflectors 51 and 64.

FIG. 4 includes several ray traces to depict how the reflectors 51 and 64 achieve this result. Rays 80, for example, travel from the back portion of ceramic tube 44 to reflect off various reflective surfaces to the front of the portable radiant heater. Ray 81 represents radiant energy that travels radially forward to reflect from planar side 71 of channel 66 to the reflector 51 to be reflected forward. Ray 82 is another example of doubling reflected radiant energy. As will be apparent from FIG. 4, the dual reflectors 51 and 64 thereby redirect the radially dispersing radiant energy from the ceramic tube 44 into a quasi coherent, forward directed radiant energy beam with minimal dispersion.

Figure 3:
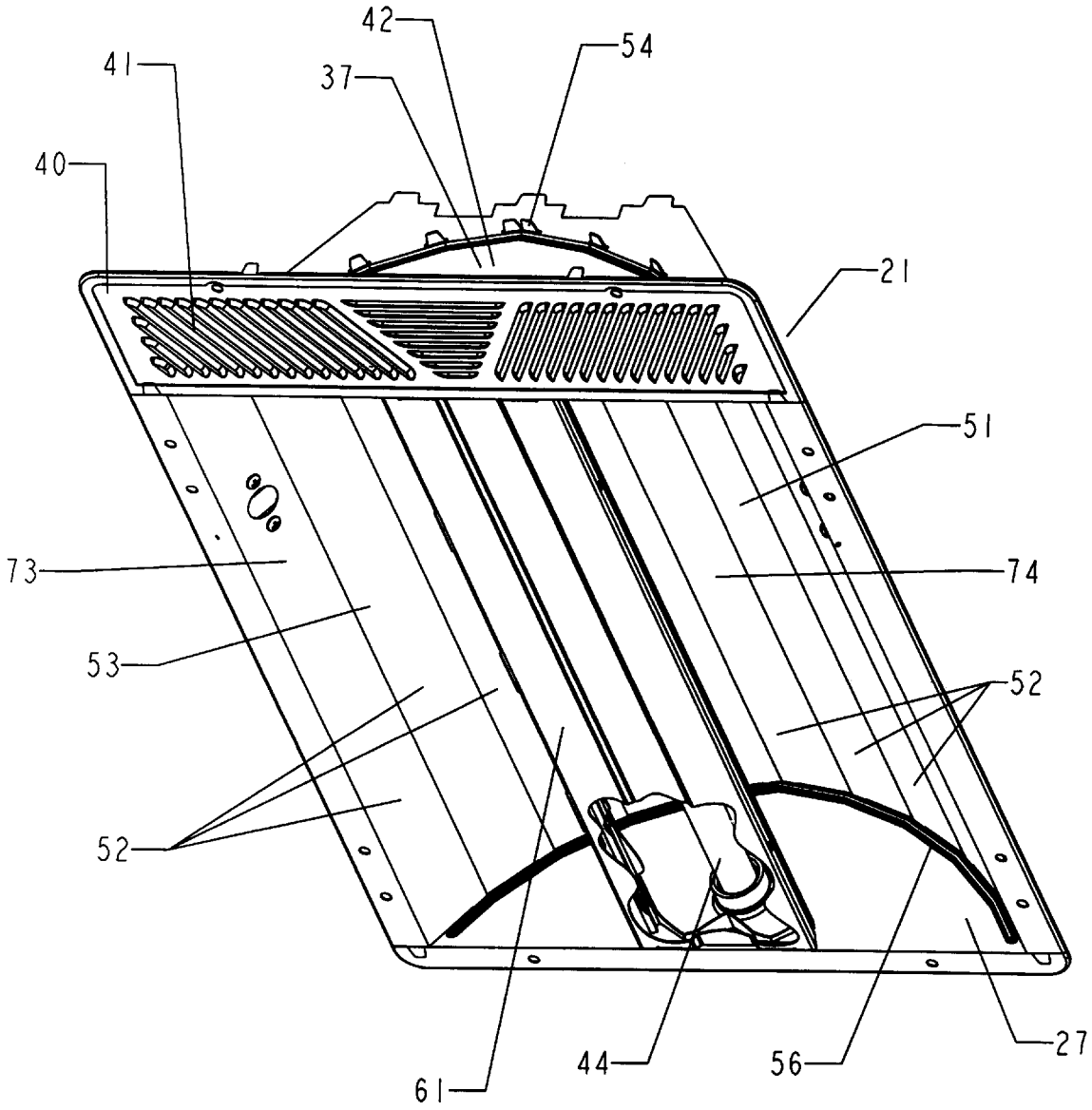
FIG. 3 is a perspective view of certain components disclosed in FIG. 1.

Referring again to FIGS. 1 through 3, in this particular embodiment the second reflector 60 is narrower than the first reflector 51. Centering the second reflector 60 on the first reflector 51 produces side passages on each side of the second reflector 60. Open grills 75 and 76 fill those passages 73 and 74 to prevent inadvertent contact with any heating elements while still allowing an individual to see into the portable radiant heater 10, particularly the reflective surfaces 53.

Referring again to FIGS. 1 and 2, placing the second reflector 60 in close proximity to the ceramic core 44 precludes any direct view of the ceramic core 44 from the exterior of the portable radiant heater 10. This positioning greatly reduces the distance between the elements that constitute the front of portable radiant heater 10 and the heating elements. Consequently, the distance to the front 85, shown in FIG. 2, is reduced; this greatly reduces the bulkiness or depth of the portable radiant heater 10.

As will also be apparent from FIG. 4, the second reflector 60, specifically the multiple reflective surfaces 72, will reflect multiple visual images of the ceramic tube 44 to the first reflector 51. The first reflector 51 will reflect those images and images produced by direct reflection of the ceramic tube 44 outward. Thus an individual looking at this device will see an array of heating elements from each facet. The net result is an aesthetically pleasing appearance.

Thus in accordance with this invention a portable radiant heater, such as the portable radiant heater 10 in FIGS. 1 and 2, includes a radiant heating element with first and second reflectors. The second reflector is closely spaced and in front of the heating element to reflect radiant energy to the rear reflector. The rear reflector directs radiant energy received directly from the heating element and indirectly from the second or front reflector to provide a heater that meets the objects of this invention, namely providing a portable radiant heater that is more efficient than prior art devices, providing a portable radiant heater that has a pleasing appearance and that has minimum depth and size.

It will also apparent that this invention has been disclosed as a specific embodiment. Any number of variations can be made to individual components while obtaining some or all of the objectives of this invention. For example, the portable radiant heater 10 has a vertically oriented heating element. For other applications the housing could be simply modified so the heating element was oriented horizontally. The front reflector is shown with two parallel, semi-hexagonal channels. A reflector with a single curved channel or even a flat reflector could be substituted still increasing efficiency and improving aesthetics. Different arrangements of the first reflector 51 with its multiple facets and concave configuration could be substituted. As previously indicated, air passages may or may not be included in various portions of the housing and other components in order to further improve cooling of the heater components. Different grillwork could obviously be substituted. It will be apparent that these and many other modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A portable heater comprising:

A) a frame for being supported in a vertical orientation including a back portion having a concave surface formed about a vertical axis and an open frame for supporting said back portion, B) an electrically operated, thermostatically controlled quartz radiant heating element, C) a support for said heating element including:

i) a bracket having a horizontal portion for connection to said housing means and a vertical portion, and ii) first and second vertically spaced end supports attached to said horizontal and vertical portions of said bracket respectively, D) a first reflector carried by said end supports including a plurality of planar members arranged about a portion of the circumference of a circle with each planar member being tangent to the circle and having a reflective surface generally directed in the direction of said radiant heater element, E) a second reflector carried by said end supports on the opposite side of said heating element comprising:

i) a reflector member having first and second parallel semi-hexagonal channels extending along channel axes parallel to the vertical axis, each of said channels having a reflective surface facing said heating element, and ii) a support member for carrying said reflector member, and F) first and second grills being disposed adjacent opposite sides of said second reflector means, the width of said first reflector being greater than the width of said second reflector and the width of said second reflector means and said first and second grills corresponding to the width of said first reflector means.

2. A portable heater comprising:

A) an upstanding housing comprising an open housing frame with front and rear frame surfaces and a curved back portion for spanning said rear frame surfaces, B) first reflector means lying along an arc for defining a concave, multifaceted reflective surface extending along a vertical axis through said upstanding housing, said first reflector means being positioned proximate said housing back portion and comprising a plurality of adjacent planar members each having a reflective surface, each planar member being positioned parallel to the vertical axis and tangent to the arc, C) an elongated radiant heating element extending along an axis parallel to the vertical axis, D) a second reflector means for defining at least one reflective surface extending parallel to the vertical axis and facing said first reflector, said second reflector means including first and second parallel, semi-hexagonal channels having reflective surfaces facing said heating element and a parallel support and first and second end plates for attaching said parallel support to said housing frame means.

3. A portable heater comprising:

A) an upstanding housing comprising an open housing frame with front and rear frame surfaces and a curved back portion for spanning said rear frame surfaces, B) first reflector means lying along an arc for defining a concave, multifaceted reflective surface extending along a vertical axis through said upstanding housing, said first reflector means being positioned proximate said housing back portion and comprising a plurality of adjacent planar members each having a reflective surface, each planar member being positioned parallel to the vertical axis and tangent to the arc, C) an elongated radiant heating element extending along an axis parallel to the vertical axis, D) a second reflector means for defining at least one reflective surface extending parallel to the vertical axis and facing said first reflector means, said first reflector means having a width transverse to the vertical axis that is greater than the corresponding width of said second reflector means, E) support means for supporting said first and second reflector means and said radiant heating element on said housing frame, and F) first and second grills disposed on opposite sides of said second reflector means.

4. A portable heater as recited in claim 3 wherein each of said grills includes an open grid structure and means for attaching said open grid structure to said housing frame means.

5. A portable heater comprising:

A) an upstanding housing comprising an open housing frame with front and rear frame surfaces and a curved back portion for spanning said rear frame surfaces, B) first reflector means lying along an arc for defining a concave, multifaceted reflective surface extending along a vertical axis through said upstanding housing, said first reflector means being positioned proximate said housing back portion and comprising a plurality of adjacent planar members each having a reflective surface, each planar member being positioned parallel to the vertical axis and tangent to the arc, C) an elongated radiant heating element extending along an axis parallel to the vertical axis, D) a second reflector means for defining at least one reflective surface extending parallel to the vertical axis and facing said first reflector means and including end plates and a parallel support, said first and second end plates attaching to said parallel support, and E) support means for supporting said first and second reflector means and said radiant heating element on said housing frame.

6. A portable heater as recited in claim 5 wherein said first reflector means has a width transverse to the vertical axis that is greater than the corresponding width of said second reflector means, said portable heater additionally comprising first and second grills disposed on opposite sides of said second reflector means.

7. A portable heater as recited in claim 6 wherein each of said grill includes an open grid structure and means for attaching said open grid structure to said housing frame means.

* * * * *